US011452191B2

(12) United States Patent
Lee et al.

(10) Patent No.: US 11,452,191 B2
(45) Date of Patent: Sep. 20, 2022

(54) WARNING LIGHT CONTROL METHOD

(71) Applicant: ESUSE AUTO PARTS MANUFACTURING CO., LTD., New Taipei (TW)

(72) Inventors: Ting-Fang Lee, New Taipei (TW); Wen-Chung Han, New Taipei (TW)

(73) Assignee: ESUSE AUTO PARTS MANUFACTURING CO., LTD., New Taipei (TW)

( * ) Notice: Subject to any disclaimer, the term of this patent is extended or adjusted under 35 U.S.C. 154(b) by 0 days.

(21) Appl. No.: 17/345,765

(22) Filed: Jun. 11, 2021

(65) Prior Publication Data

US 2022/0272818 A1 Aug. 25, 2022

(30) Foreign Application Priority Data

Feb. 25, 2021 (TW) ..... 110106770

(51) Int. Cl.
*H05B 47/16* (2020.01)
*H05B 47/155* (2020.01)

(52) U.S. Cl.
CPC ..... *H05B 47/16* (2020.01); *H05B 47/155* (2020.01)

(58) Field of Classification Search
CPC ..... H05B 47/10; H05B 47/16; H05B 47/155; H05B 47/165; B60Q 1/44; B60Q 1/26
See application file for complete search history.

(56) References Cited

U.S. PATENT DOCUMENTS

2014/0239807 A1* 8/2014 Hammock ..... B60Q 1/445 315/77
2020/0029642 A1* 1/2020 Kinney ..... B62J 6/045

* cited by examiner

*Primary Examiner* — Jimmy T Vu
(74) *Attorney, Agent, or Firm* — Muncy, Geissler, Olds & Lowe, P.C.

(57) ABSTRACT

A warning light control method includes the steps of: accepting multiple warning lights to receive a start command to set up Flash Mode and numbering each warning light sequentially starting from 1, and using Flash Mode number to synchronously set ID Number of each warning light; setting the ID Number of a predetermined warning light as Starter and the remaining ID Numbers as Receivers; the warning light of Starter receiving Start Command from Control Bus through cable, and sending Data, Clock Pulse and ID Information from Data Bus, and selecting one for flashing by Flash Mode; warning lights of Receivers get Data, Clock Pulse and ID Information from Data Bus through cables thereof, and warning lights of Receivers and Starter are flashing synchronously or asynchronously; whether Control Bus of Starter and Receivers has received Change ID Command.

8 Claims, 9 Drawing Sheets

WARNING LIGHT CONTROL METHOD

This application claims the priority benefit of Taiwan patent application number 110106770, filed on Feb. 25, 2021.

BACKGROUND OF THE INVENTION

1. Field of the Invention

The present invention relates to warning light control technology, and more particularly to a warning light control method, which sets an ID Number for each warning light, enables the Starter to transmit data, clock and identity signals through the Data Bus to control multiple Receivers, without the need for an additional electronic control device to control the flashing mode of multiple warning lights. It can improve the stability of the warning light control and the coordination of flashing, and can reduce the manufacturing cost of the light device, which will help the price competitiveness in the sales market.

2. Description of the Related Art

Warning lights are used in many environments and places, such as road construction warnings, public places safety warnings, high-rise building safety warnings, fire trucks, ambulances and police vehicles, etc. The warning light can be divided into a single warning light or a light device composed of plural warning lights. The light device is mostly installed on the roof of the aforementioned vehicle that needs to be warned. The conventional light device needs to add an electronic control device to control multiple warning lights to achieve the warning effect of coordinating the flashing of multiple warning lights. At present, the appearance and flashing effects of all warning lights on the market are almost the same. However, the flashing effect of multiple warning lights controlled by an electronic control device is not very coordinated, and it also causes the warning effect to be poor. In addition, the additional electronic control device in the market light device also increases the manufacturing cost, and the sales price of the light device terminal also increases, which is not conducive to the price competitiveness in the sales market. Therefore, how to try to solve the above-mentioned deficiencies and inconveniences of prior art light device is the direction that relevant industries urgently want to study and improve.

SUMMARY OF THE INVENTION

The present invention has been accomplished under the circumstances in view. It is therefore the main object of the present invention to provide a warning light control method, which includes the following steps: accept multiple warning lights to receive a start command to set up a Flash Mode and number each warning light sequentially starting from 1, and use the Flash Mode number to synchronously set the ID Number of each warning light; set the ID Number of one predetermined warning light as a Starter and the remaining ID Numbers as Receivers; the warning light set as Starter receives a start command signal from the Control Bus through the cable thereof, and sends a Data, a Clock Pulse and an ID Information from the Data Bus, and selects one for flashing by the Flash Mode; the warning lights set as Receivers get the Data, the Clock Pulse and the ID Information from the Data Bus through the cables thereof, and the warning lights of the Receivers and the Starter are flashing synchronously or asynchronously; whether the common Control Bus of the Starter and the Receivers has received a Change ID Command. Through the aforementioned Light Device control steps, set each warning light to have its ID Number. The Starter transmits data, clock and identity signals through the Data Bus to control multiple Receivers, without the need to set up an electronic control device to control the flashing mode of multiple warning lights. At the same time, it can improve the stability of the warning light control and the coordination of flashing, and can reduce the manufacturing cost of the light device, which will help the price competitiveness in the sales market.

According to another aspect of the present invention, the Flash Mode comprises the mode of Synchronous, the mode of Interlace, the mode of Polling and the mode of Recursive. The Starter controls the Receivers to flash.

According to still another aspect of the present invention, each warning light comprises a PCB on which a plurality of LEDs, at least one EEPROM, and a plurality of pads for electrical connection of a plurality of cables are arranged.

According to still another aspect of the present invention, the Receivers execute a Self Flash Mode first before executing the light flashing.

According to still another aspect of the present invention, the ID Numbers of the warning lights that are set as the Receivers are divided into odd and even numbers by the ID Number of the Starter, and the Clock Pulse sent by the Starter is used to make the odd and even numbers of the warning light of the Receivers execute Synchronous or Interlace Flash Mode.

According to still another aspect of the present invention, before the Flash Mode selects one to flash the light, the warning light that is set as the Starter performs an EEPROM data initialization.

According to still another aspect of the present invention, before the warning lights that are set as Receivers get any signal from the Control Bus and the Data Bus through the cables thereof, the warning lights that are set as Receivers flash according to the Flash Mode stored in their EEPROM.

DETAILED DESCRIPTION OF THE PREFERRED EMBODIMENT

Figure 1:
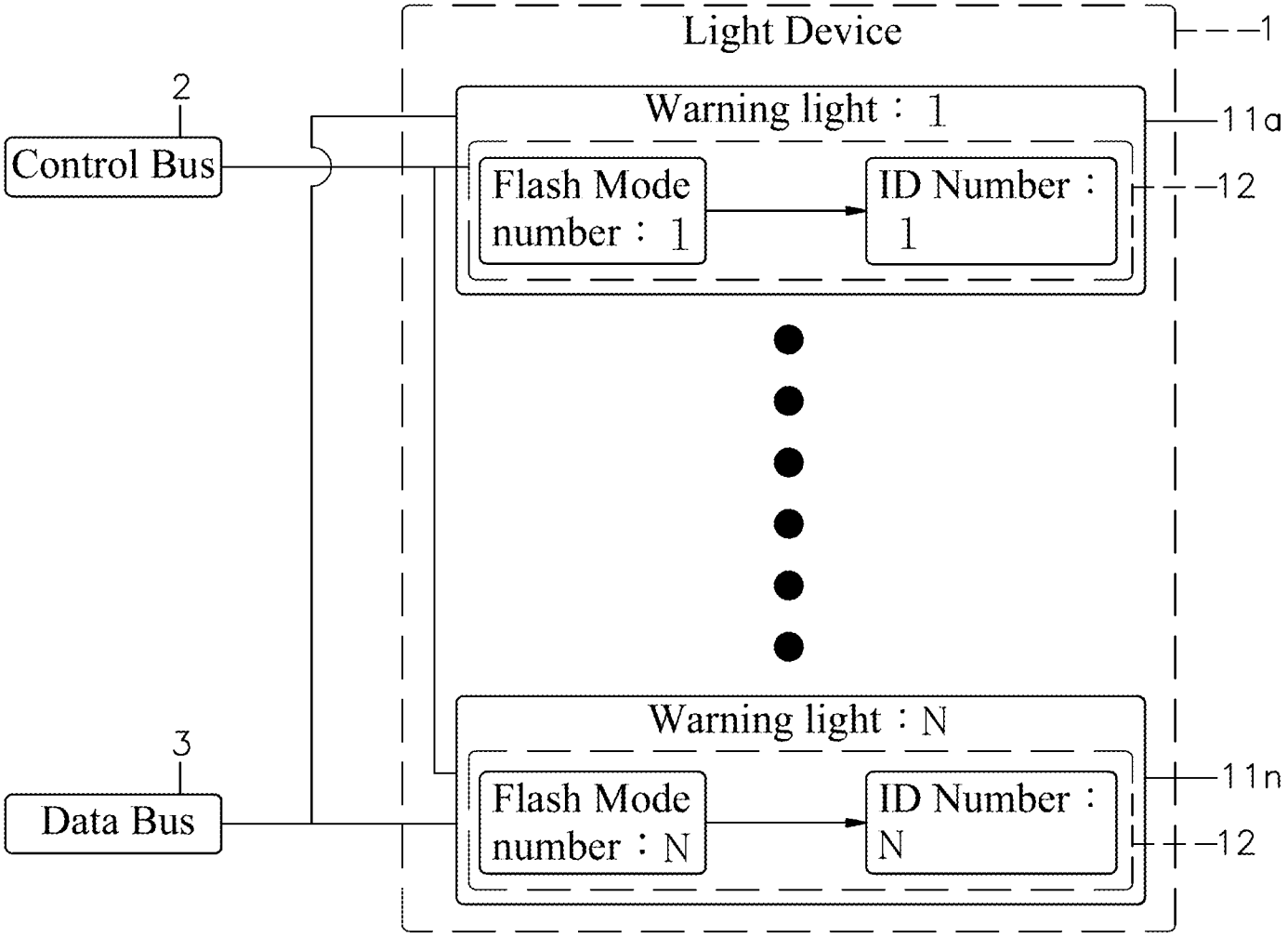
FIG. 1 is a function block diagram of a Light Device and its control architecture according to the present invention.

Referring to FIGS. 1-3 and 5-6, the Light Device control architecture of the present invention comprises a Light Device 1, a Control Bus 2 and a Data Bus 3. Its main component and features are detailed as follows:

Referring to FIG. 1, the Light Device 1 comprises a plurality of warning lights (11*a*~11*n*), and each of these warning lights (11*a*~11*n*) is electrically connected to the Control Bus 2 and the Data Bus 3 through a cable. These warning lights (11*a*~11*n*) each have built therein an EEPROM 12. Each of the warning lights (11*a*~11*n*) comprises a PCB (not shown), and a plurality of LEDs (not shown), at least one EEPROM 12, and a plurality of Pads (not shown) for electrical connection of a plurality of cables are arranged on the PCB.

Figure 2:
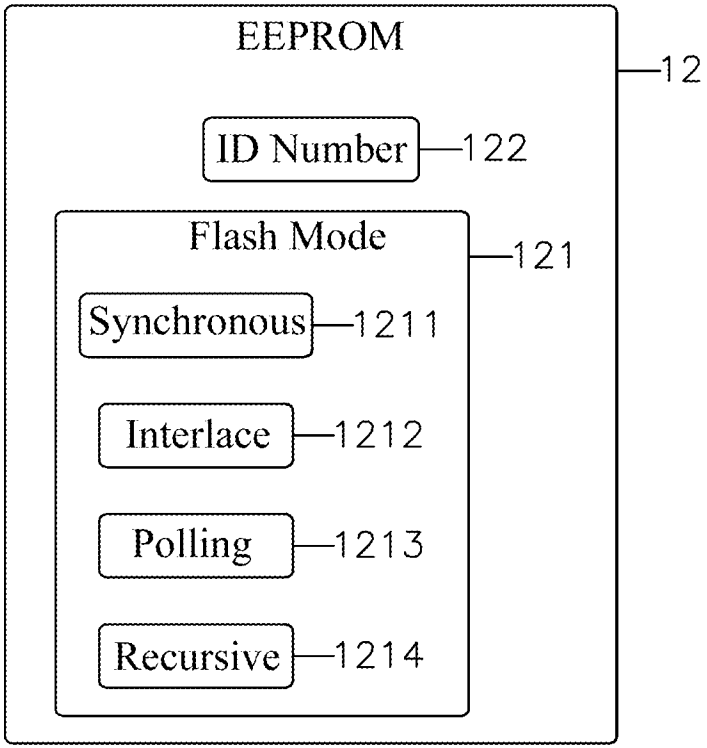
FIG. 2 is a function block diagram of an EEPROM according to the present invention.

Referring to FIG. 2, the EEPROM 12 of each of the warning lights (11*a*~11*n*) has stored therein a Flash Mode 121 and an ID Number 122. The Flash Mode 121 includes Synchronous 1211, Interlace 1212, Polling 1213 and Recursive 1214.

In addition to the aforementioned Flash Mode 121, a Starter 4 can also use the Data Bus 3 to control multiple Receivers 5 to flash in different modes (for example: the first Receiver is to do Synchronous, the second Receiver is to do Polling, and the third Receiver is to do Interlace). The aforementioned control of the flashing of the multiple Receivers 5 by the Starter 4 is also within the protection scope of the present invention. The ID Number 122 is determined by the Control Bus 2's Start Command 21 and Change ID Command 22. Therefore, the ID Numbers 122 of the warning lights (11*a*~11*n*) are in a floating state, but they can only be changed when the above two signals (21, 22) are received.

Figure 3:
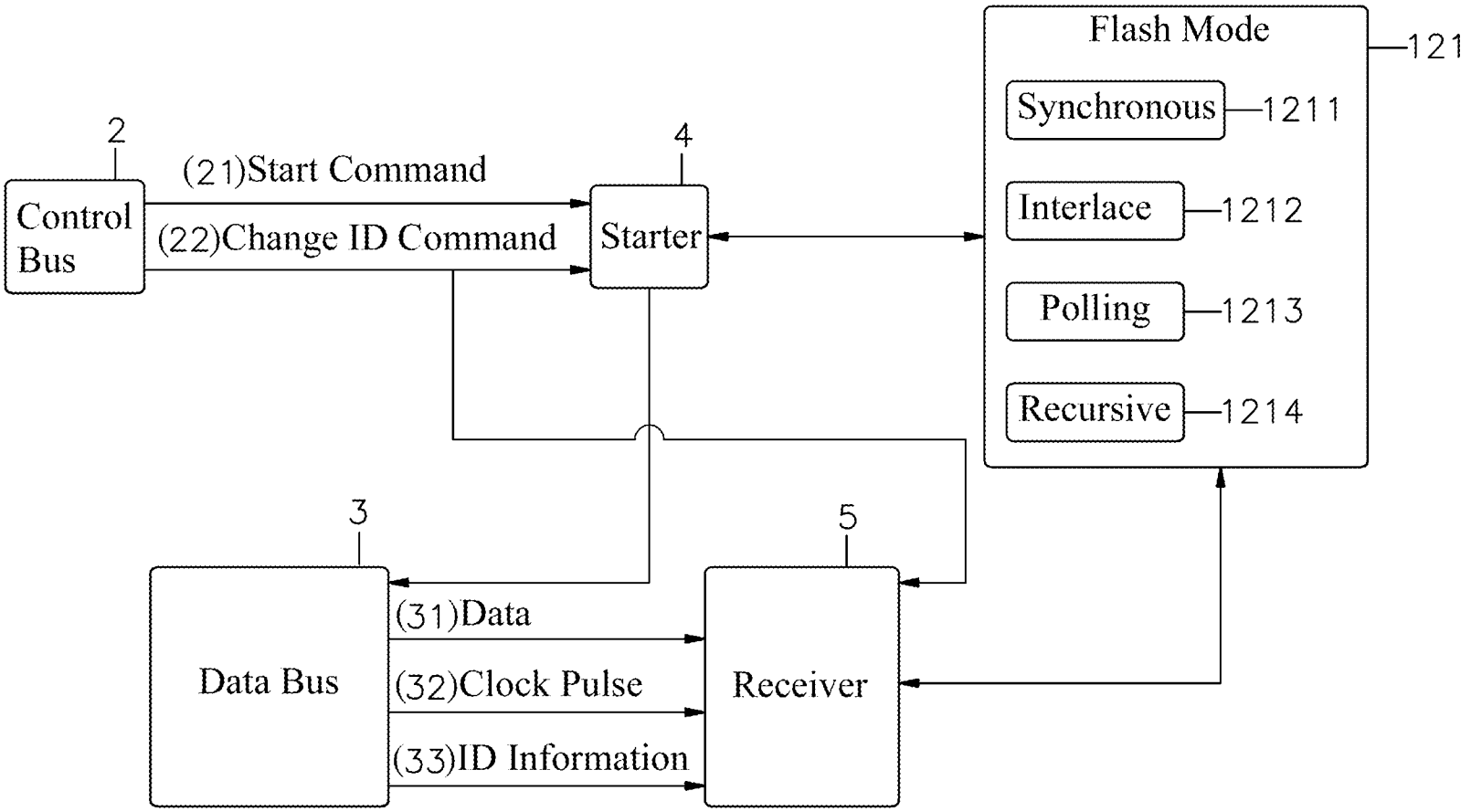
FIG. 3 is another function block diagram of the Light Device and its control architecture according to the present invention.
Figure 5:
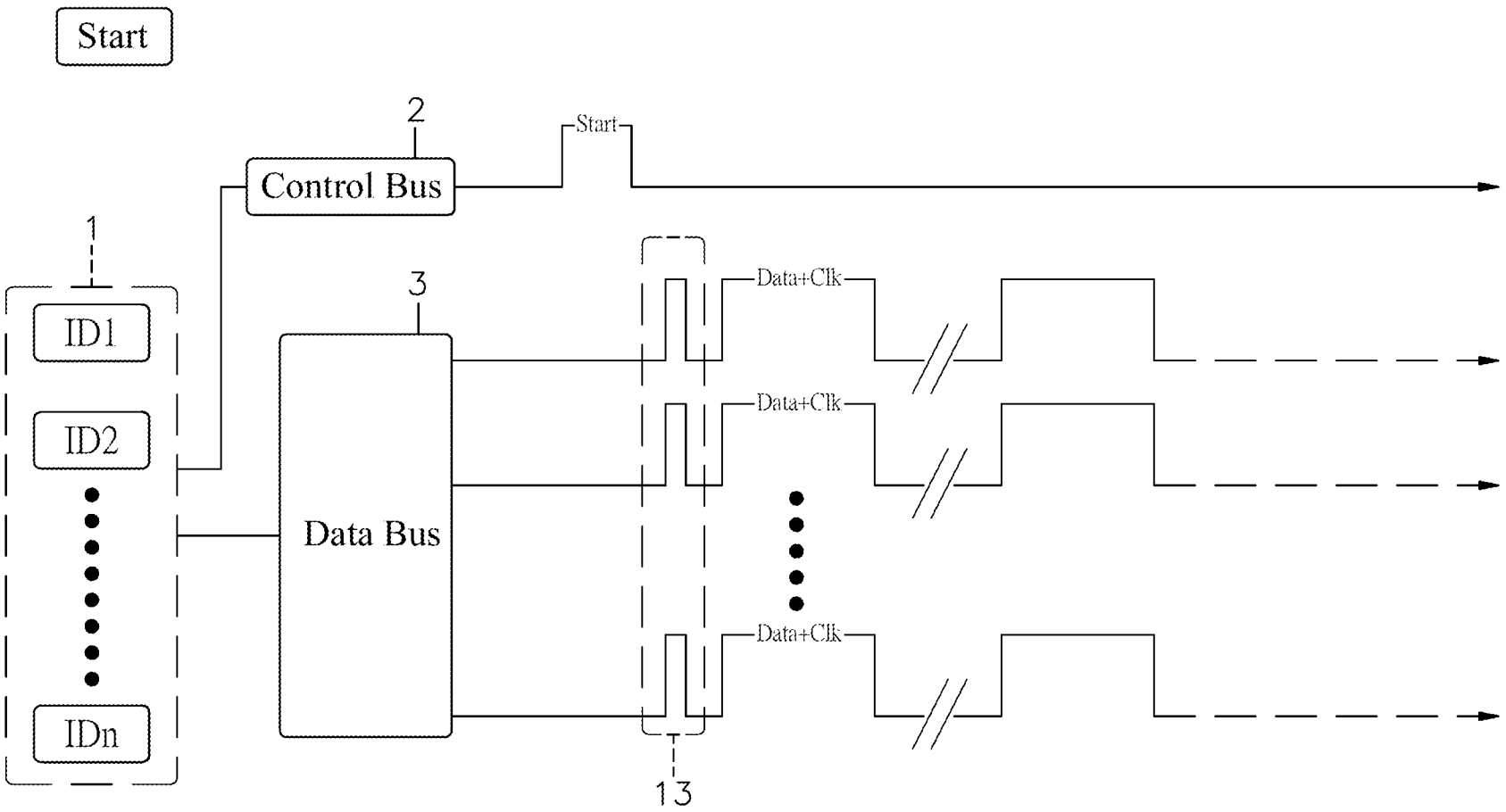
FIG. 5 is a pulse wave signal diagram of the present invention when the warning lights of the Starter and the Receivers are in the start mode.

Referring to FIG. 3, the Control Bus 2 sends out the Start Command 21 to notify the multiple warning lights (1*a*~11*n*), set the Flash Mode 121 and sequentially number each warning light (11*a*~11*n*) by starting from 1, and use the Flash Mode 121 number to synchronously set the ID Number 122 of each warning light (11*a*~11*n*). Set the predetermined ID Number of these warning lights (11*a*~11*n*) to the Starter 4, and the rest of the ID Numbers to the Receiver 5. The warning light set to Starter 4 receives the Start Command 21 from the Control Bus 2 through its cable, and sends a Data 31, a Clock Pulse 32 and an ID Information 33 from the Data Bus 3. Select one of them (Synchronous 1211, Interlace 1212, Polling 1213, Recursive 1214, Flash Mode of multiple Receivers controlled by Starter) by the Flash Mode 121 to flash the lights. From the warning lights set to Receiver 5 through their cables, the Data 31, the Clock Pulse 32 and the ID Information 33 are obtained from the Data Bus 3. The Receivers 5 and the Flash Mode 121 of the Starter 4 are flashing lights synchronously or asynchronously. Before these Receivers 5 execute the light flashing, execute a Self Flash Mode 13 (as shown in FIG. 5).

The above multiple warning lights (11*a*~11*n*) are synchronized to set the ID Number 122 of each warning light (11*a*~11*n*) through the Flash Mode 121 number. Generally speaking, the one that can set the ID Number to 1 is the Starter 4. But the present invention is not self-limiting. Each ID Number can be set as Starter 4 through the Control Bus 2. For example: the ID Number 2, 5, 8 and other numbers other than 1 may also be used as Starter 4. The mode of setting the warning light (11*a*~11*n*) of any ID Number through the Control Bus 2 as Starter 4 is also protected by the present invention.

Figure 6:
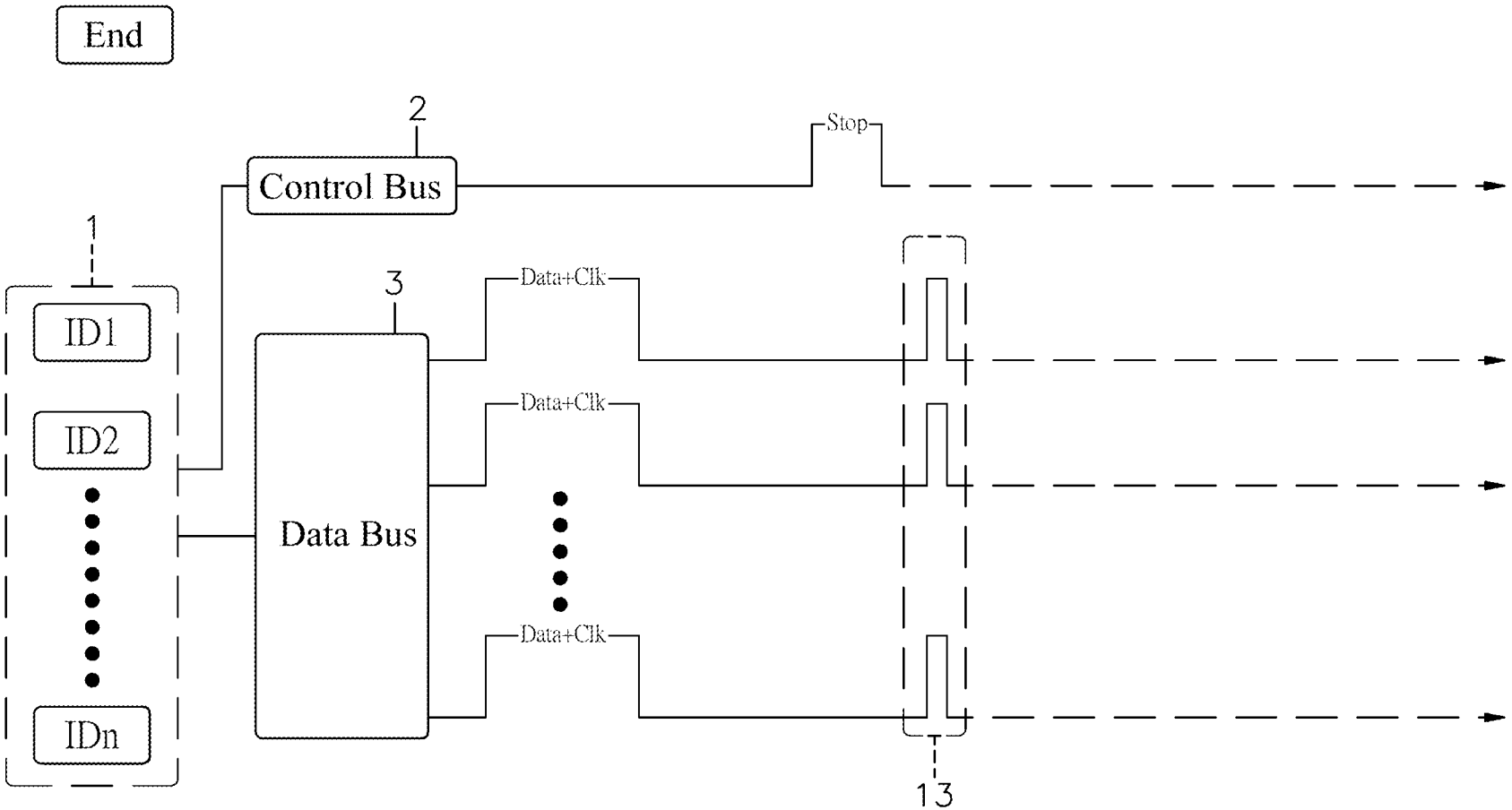
FIG. 6 is a pulse wave signal diagram of the present invention when the warning lights of the Starter and the Receivers are in the end mode.

When the Starter 4 and the Receivers 5 are synchronized or not synchronized, the lights are flashing, if they receive the Change ID Command 22 sent by their common Control Bus 2, then the ID of the Starter 4 and the plural Receivers 5 will be changed. The specific method is that before the Starter 4 and the Receivers 5 change their identities, the Receivers 5 suspend the current Flash Mode 121 and then execute the Self Flash Mode 13 (as shown in FIG. 6). The Control Bus 2 will re-send a Start Command 21 to notify the multiple warning lights (11*a*~11*n*), set the Flash Mode 121 and number each warning light (11*a*~11*n*) sequentially by starting from 1, and use the Flash Mode 121 number to synchronously set the ID Number 122 of each warning light (11*a*~11*n*).

Figure 4:
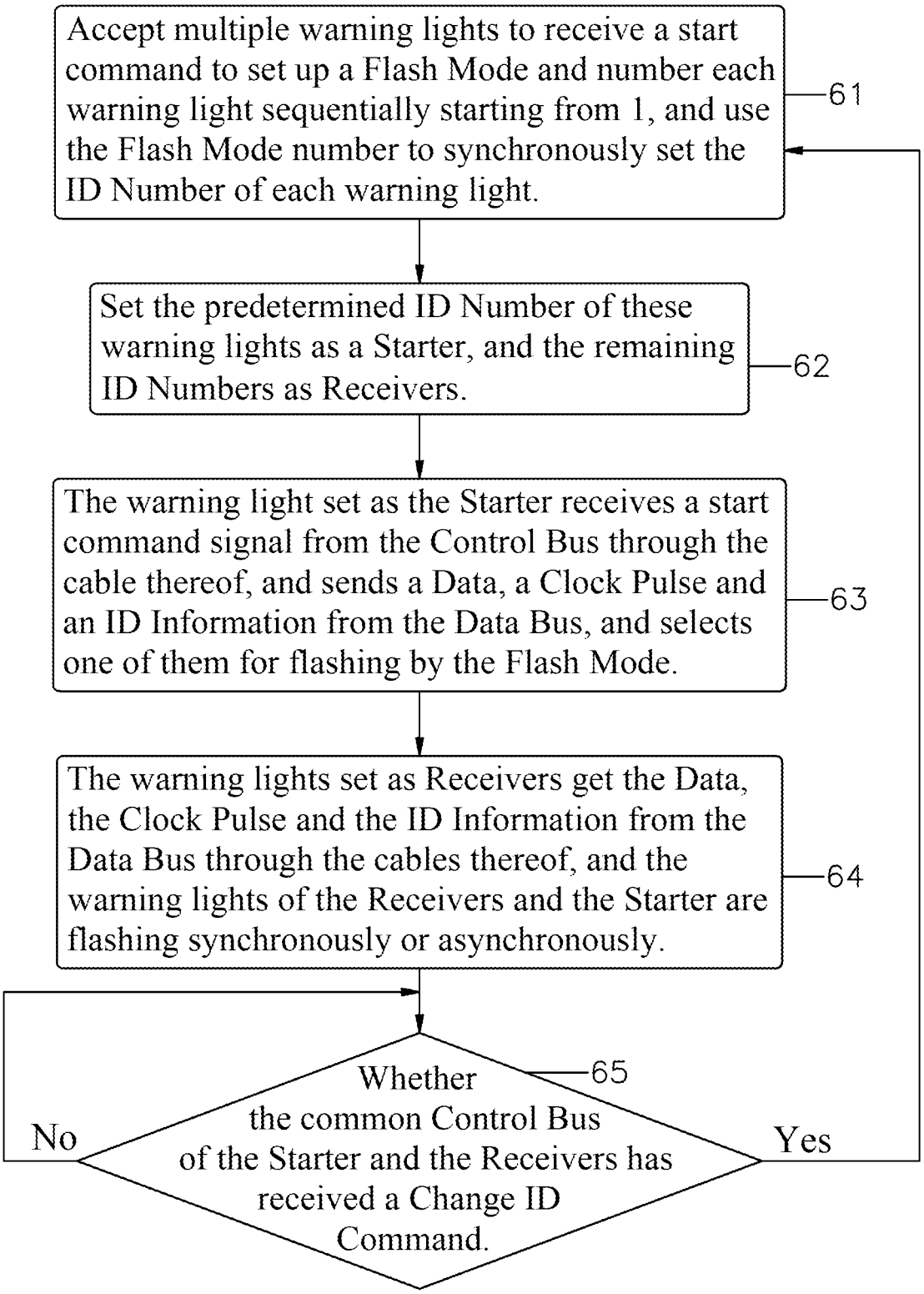
FIG. 4 is a control flow chart of the Light Device of the present invention.

Please refer to FIG. 4, which is the control flow chart of the Light Device of the present invention, which includes the following steps:

61: Accept multiple warning lights to receive a start command to set up a Flash Mode and number each warning light sequentially starting from 1, and use the Flash Mode number to synchronously set the ID Number of each warning light.

62: Set the predetermined ID Number of these warning lights as a Starter, and the remaining ID Numbers as Receivers. The ID Numbers of the warning lights that are set as the Receiver are divided into odd numbers and even numbers by the ID Number of the Starter. For example: if the Starter ID Number is an even number, the next Receiver is an odd number, and the next Receiver is also an even number, follow the above and so on. And use the clock signal sent by the Starter to make the warning lights of the odd-numbered and even-numbered receivers execute the Flash Mode of Synchronous or Interlace.

63: The warning light set as Starter receives a start command signal from the Control Bus through its cable, and sends a Data, a Clock Pulse and an ID Information from the Data Bus, and selects one of them for flashing by the Flash Mode. Before selecting one of them by the Flash Mode to flash the light, the warning light set as the Starter perform an EEPROM data initialization.

64: The warning lights set as Receivers get the Data, the Clock Pulse and the ID Information from the Data Bus through their cables, and the warning lights of the Receivers and the Starter are flashing synchronously or asynchronously. Before these Receivers execute the light flashing, execute a Self Flash Mode first. Before the warning lights that are set as Receivers get any signal from the Control Bus and the Data Bus through the cables thereof, the warning lights that are set as Receivers flash according to the Flash Mode stored in their EEPROM.

65: Whether the common Control Bus of the Starter and the Receivers has received a Change ID Command, if yes, go to step 61; if no, continue to execute the original Flash Mode. Before the Starter and the Receivers change their identities, the Receivers suspend the current Flash Mode and then execute a Self Flash Mode.

Figure 7:
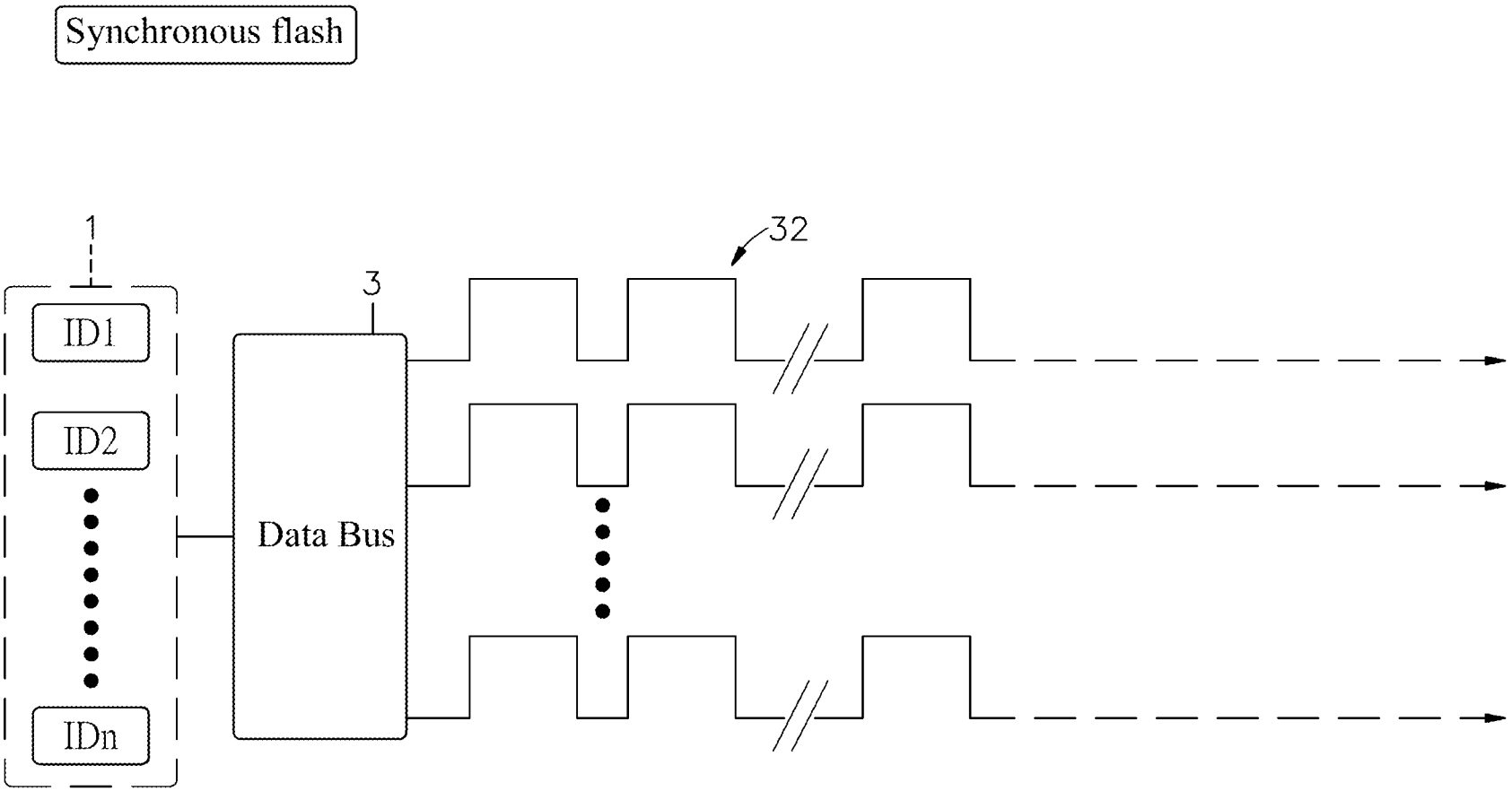
FIG. 7 is a pulse wave signal diagram of the present invention when the warning lights of the Starter and the Receivers are in the mode of synchronous.

Please refer to FIG. 7, which is a pulse wave signal diagram when the warning lights of the Starter and the Receivers of the present invention are in the flash mode of Synchronous. When the Starter 4 (ID1) of the Light Device 1 flashes a light from the Data Bus 3 by the Clock Pulse 32, the light flashing signal in this embodiment is to flash twice continuously and then flash again after an interval of time, and the aforementioned light flashing signal repeats the cycle. The present invention does not limit itself to this. The Starter 4 (ID1) can also use the Data Bus 3 to transfer the Clock Pulse 32, and control the multiple Receivers 5

(ID2~IDn) to follow the Starter 4 (ID1) to execute the Synchronous 1211 in the Flash Mode 121.

Figure 8:
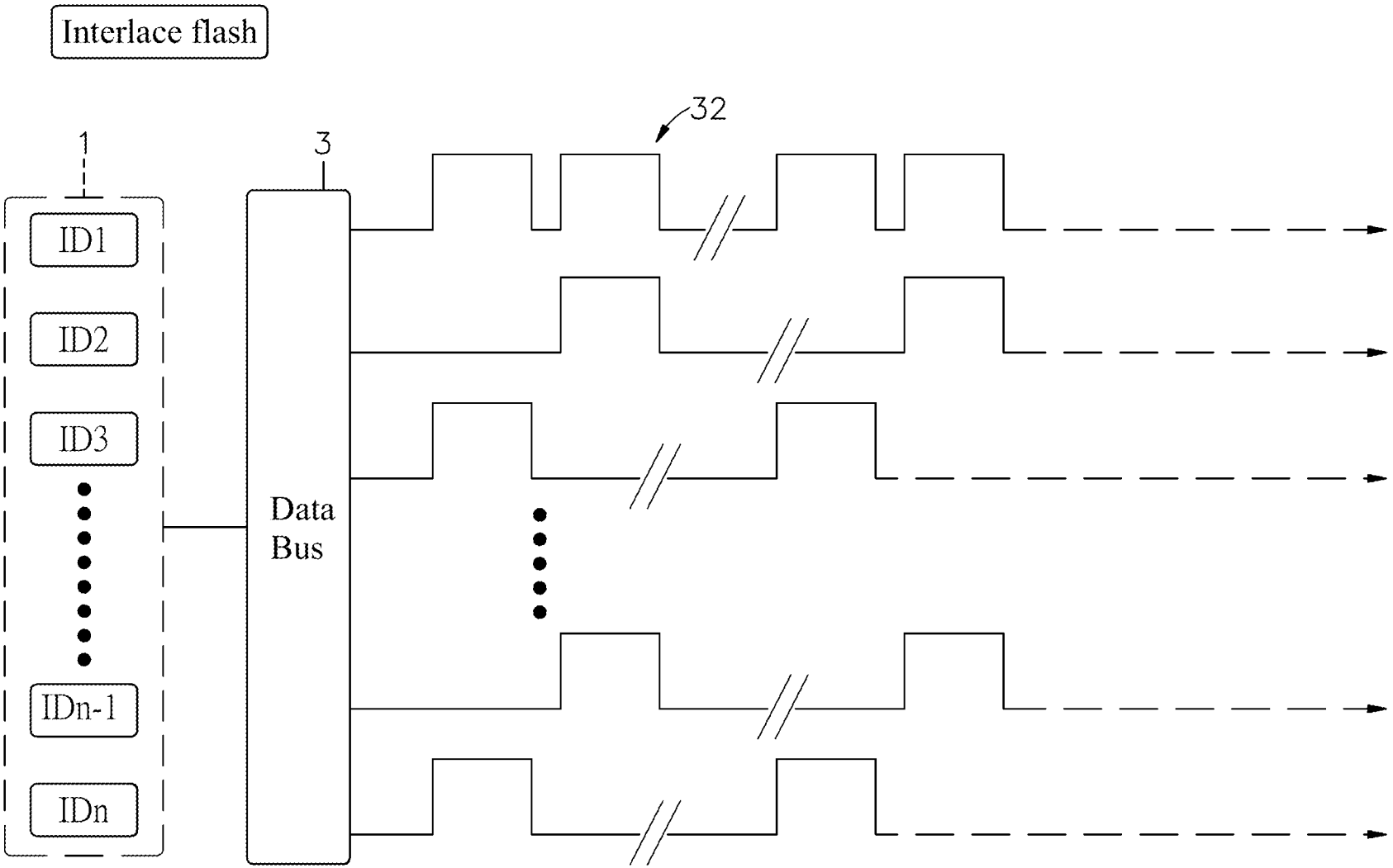
FIG. 8 is a pulse wave signal diagram of the present invention when the warning lights of the Starter and the Receivers are in the mode of Interlace.

Please refer to FIG. 8, which is a pulse wave signal diagram when the warning lights of the Starter and the Receivers of the present invention are in the flash mode of Interlace. When the Starter 4 (ID1) of the Light Device 1 flashes a light from the Data Bus 3 by the Clock Pulse 32, the light flashing signal in this embodiment first flashes twice continuously (each is the first flash and the second flash), and then flashes twice after an interval of time (each is the third flash and the fourth flash), and the aforementioned light flashing signal repeats the cycle. Of course, the aforementioned light flashing signal is only an example, and the present invention is not self-limited by this. The Starter 4 (ID1) can also use the Data Bus 3 to transfer the Clock Pulse 32, and control the multiple Receivers 5 (ID2~IDn) to follow the Starter 4 (ID1) to execute the Interlace 1212 in the Flash Mode 121. The so-called Interlace is the ID Numbers of the plural Receivers 5 (ID2~IDn) are divided into odd and even numbers. For example: the ID Number of the Receiver 5 (ID2) located under the Starter 4 (ID1) is an even number, which flashes following the second and fourth flashes of the Starter 4 (ID1); the ID Number of the Receiver 5 (ID3) located under the Receiver 5 (ID2) is an odd number, which flashes following the first and third flashes of the Starter 4 (ID1). The light flashing of the adjacent Receivers 5 is formed in a staggered state by the aforementioned light flashing signal.

Figure 9:
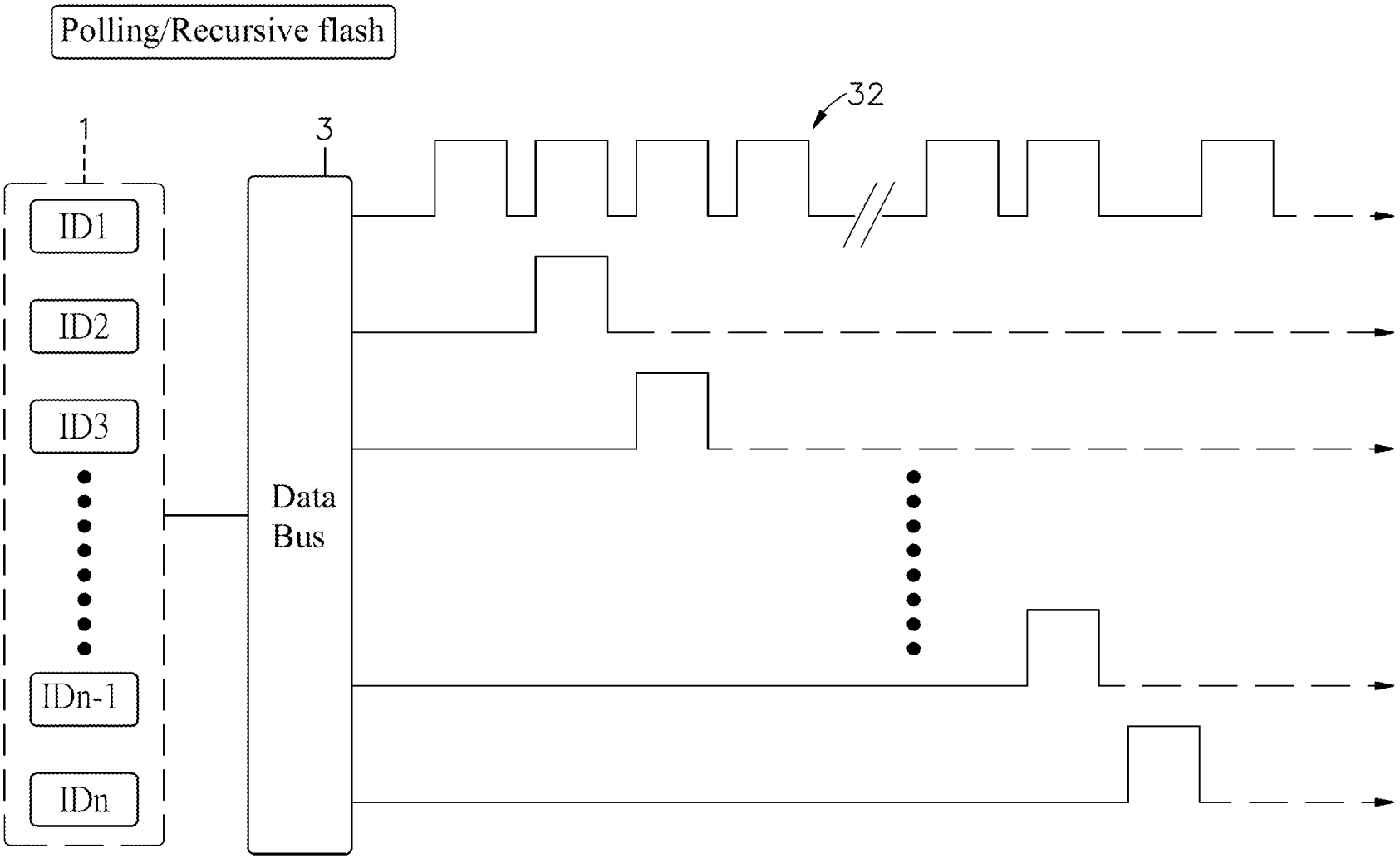
FIG. 9 is a pulse wave signal diagram of the present invention when the warning lights of the Starter and the Receivers are in the mode of Polling/Recursive.

Please refer to FIG. 9, which is a pulse wave signal diagram when the warning lights of the Starter and the Receivers of the present invention are in the flash mode of Polling/Recursive. When the Starter 4 (ID1) of the Light Device 1 flashes a light from the Data Bus 3 by the Clock Pulse 32, the light flashing signal in this embodiment is continuous flashing. The Starter 4 (ID1) can also use the Data Bus 3 to transfer the Clock Pulse 32, and control the multiple Receivers 5 (ID2~IDn) to follow the Starter 4 (ID1) to execute the Polling 1213 or Recursive 1214 in the Flash Mode 121. The so-called Polling 1213 is that, after the ID Numbers of the plural Receivers 5 (ID2~IDn) are divided into odd and even numbers, the Receiver 5 (ID2) flashes following the second flash of the Starter 4 (ID1), the Receiver 5 (ID3) located under the Receiver 5 (ID2) flashes following the third flash of the Starter 4 (ID1), and the remaining Receivers 5 flash according to the aforementioned rules and so on, forming the Polling 1213 in the Flash Mode 121. The so-called Recursive 1214 is that, after the ID Numbers of the plural Receivers 5 (ID2~IDn) are divided into odd and even numbers, the last Receiver 5 (IDn) flashes following the second flash of the Starter 4 (ID1); the second-to-last Receiver 5 (IDn−1) above the last Receiver 5 (IDn) flashes following the third flash of the Starter 4 (ID1), and the remaining Receivers 5 flash according to the aforementioned rules and so on, forming the Recursive 1214 in the Flash Mode 121.

According to the disclosure in FIGS. 1 to 9 above, it can be understood that the present invention is a warning light control method, which includes the following steps: accept multiple warning lights to receive a start command to set up a Flash Mode and number each warning light sequentially starting from 1, and use the Flash Mode number to synchronously set the ID Number of each warning light; set the ID Number of one predetermined warning light as a Starter and the remaining ID Numbers as Receivers; the warning light set as Starter receives a start command signal from the Control Bus through the cable thereof, and sends a Data, a Clock Pulse and an ID Information from the Data Bus, and selects one for flashing by the Flash Mode; the warning lights set as Receivers get the Data, the Clock Pulse and the ID Information from the Data Bus through the cables thereof, and the warning lights of the Receivers and the Starter are flashing synchronously or asynchronously; whether the common Control Bus of the Starter and the Receivers has received a Change ID Command. Through the aforementioned Light Device control steps, set each warning light to have its ID Number. The Starter transmits data, clock and identity signals through the Data Bus to control multiple Receivers, without the need to set up an electronic control device to control the flashing mode of multiple warning lights. At the same time, it can improve the stability of the warning light control and the coordination of flashing, and can reduce the manufacturing cost of the light device, which will help the price competitiveness in the sales market. The present invention has excellent practicability when applied to vehicles equipped with the light device (e.g. fire trucks, ambulances and police vehicles), so a patent application was filed to seek patent protection.

What the invention claimed is:

1. A warning light control method for controlling the operation of a light device comprising a plurality of warning lights, each of said warning lights being electrically connected to a control bus and a data bus through a cable, the warning light control method comprising the steps of:

A. accept said warning lights to receive a start command to set up a flash mode and number each said warning light sequentially starting from 1, and use said flash mode number to synchronously set an ID number of each said warning light;

B. Set said ID number of one of said warning lights as a starter, and the rest of said ID numbers as receivers;

C. the said warning light set as starter receives a start command signal from said control bus through the cable thereof, and sends a data, a clock pulse and an ID information from said data bus, and selects one for flashing by said flash mode;

D. the said warning lights set as receivers get said data, said clock pulse and said ID information from said data bus through the cables thereof, and said warning lights of said receivers and said starter are flashing synchronously or asynchronously; and E. whether the common control bus of said starter and said receivers has received a change ID command, if yes, go to step A; if no, continue to execute the original said flash mode.

2. The warning light control method as claimed in claim 1, wherein said flash mode comprises the mode of synchronous, the mode of interlace, the mode of polling and the mode of recursive; said starter controls said receivers to flash.

3. The warning light control method as claimed in claim 1, wherein each said warning light comprises a printed circuit board (PCB) on which a plurality of light emitting diodes (LEDs), at least one electronically erasable programmable read-only memory (EEPROM), and a plurality of pads for electrical connection of a plurality of cables are arranged.

4. The warning light control method as claimed in claim 1, wherein in Step B, said ID numbers of the said warning lights that are set as said receivers are divided into odd and even numbers by said ID number of said starter, and said clock pulse sent by said starter is used to make the odd and even numbers of the said warning lights of said receivers execute synchronous or interlace flash mode.

5. The warning light control method as claimed in claim 1, wherein in Step C, before said flash mode selects one to flash the light, the said warning light set as said starter performs an electronically erasable programmable read-only memory (EEPROM) data initialization.

6. The warning light control method as claimed in claim 1, wherein in Step D, said receivers execute a self flash mode first before executing the light flashing.

7. The warning light control method as claimed in claim 1, wherein in Step D, before the said warning lights that are set as said receivers get any signal from said control bus and said data bus through the cables thereof, the said warning lights that are set as said receivers flash according to said flash mode stored in their said electronically erasable programmable read-only memory (EEPROM).

8. The warning light control method as claimed in claim 1, wherein in Step E, before said starter and said receivers change their identities, said receivers suspend the current said flash mode and then execute said self flash mode.

* * * * *